United States Patent [19]

Rosenschein

[11] Patent Number: 5,072,352

[45] Date of Patent: Dec. 10, 1991

[54] TROUBLE LAMP

[76] Inventor: Warner Rosenschein, 53 Point St., New Hamburg, N.Y. 12560

[21] Appl. No.: 662,437

[22] Filed: Feb. 28, 1991

[51] Int. Cl.[5] ..... F21L 15/12

[52] U.S. Cl. ..... 362/400; 362/282; 362/323; 362/378

[58] Field of Search ..... 362/109, 186, 277, 282, 362/322, 323, 325, 376, 378, 399, 400

[56] References Cited

U.S. PATENT DOCUMENTS

| | | | |
|---|---|---|---|
| 3,755,668 | 8/1973 | Moreschini | 362/378 X |
| 4,321,660 | 3/1982 | Sokol | 362/378 X |
| 4,419,720 | 12/1983 | Kenney | 362/378 X |
| 4,594,647 | 6/1986 | Dippert | 362/376 |

*Primary Examiner*—Stephen F. Husar
*Attorney, Agent, or Firm*—Alfred C. Hill

[57] ABSTRACT

A trouble lamp comprising a longitudinal handle including at one end thereof a light bulb socket; a fixed circular based member secured to the handle adjacent the one end thereof in a coaxial relationship with the socket, the base member having a circular groove in an upper surface thereof adjacent the periphery thereof; a partially circular-like, open sided shade member extending outwardly from the upper surface having one end thereof enclosed and the other end thereof engaging the groove; and a stationary arrangement extending from the upper surface to the enclosed end of the shade member to provide a pivot member for the shade member to enable rotation of the shade member about the pivot member in the groove.

20 Claims, 1 Drawing Sheet

TROUBLE LAMP

BACKGROUND OF THE INVENTION

The present invention relates to light fixtures and more particularly to a trouble light or lamp.

Trouble lamps are well known and conventionally employ a handle containing a light bulb socket and a stationary shade member along with a protective cage for the light bulb. A major problem with these prior art trouble lamps is that when they are in place the trouble lamp will rotate so that the light from the light bulb shines in the user's eyes.

U.S. Pat. No. 4,019,047 discloses therein one arrangement for overcoming the above mentioned problem by providing a relatively rotateable relationship between the magnet employed to mount the trouble light for use and the case at its mid point thereby providing a balanced mounting of the trouble lamp, and easy adjustment of the shade member so as to not have the light shine in the user's eyes.

Another known prior art arrangement for overcoming the above mentioned disadvantage is found in U.S. Pat. No. 4,321,660 which discloses a trouble light having a longitudinally extending handle and a first apertured ball and socket carried on one end thereof and a longitudinally extending bulb carrying section also carrying a ball and socket thereon. The balls are rigidly connected by a tube to thereby position the handle and bulb carrying section in space proximity to each other and to enable relative rotative and angular movement with respect to each other.

SUMMARY OF THE INVENTION

An object of the present invention is to provide a trouble lamp having an improved arrangement to able easy adjustment of the shade so as to not shine light into the user's eyes.

A feature of the present invention is the provision of a trouble lamp comprising a longitudinal handle including at one end thereof a light bulb socket; a fixed, circular base member secured to the handle adjacent the one end thereof in a coaxial relationship with the socket, the base member having a circular groove in an upper surface thereof adjacent the periphery thereof; a partially circular-like, open sided shade member extending outwardly from the upper surface having one end thereof enclosed and the other end thereof engaging the groove; and a stationary arrangement extending from the upper surface to the enclosed end of the shade member to provide a pivot member for the shade member to enable rotation of the shade member about the pivot member in the groove.

Another feature of the present invention is the provision of a trouble lamp having in addition to the above mentioned members a pair of additional members each forming an extension of a different one of the two sides of the open side of the shade member, each of the pair of members being angled outwardly relative to the shade member to enhance shielding the eyes of a user from light emitted from the trouble lamp.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
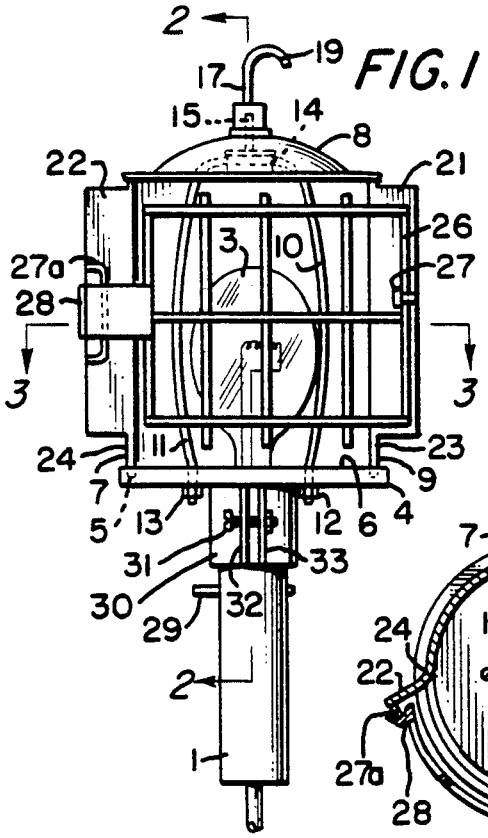
FIG. 1 is a front view of one embodiment of the trouble lamp in accordance with the principles of the present invention.
Figure 2:
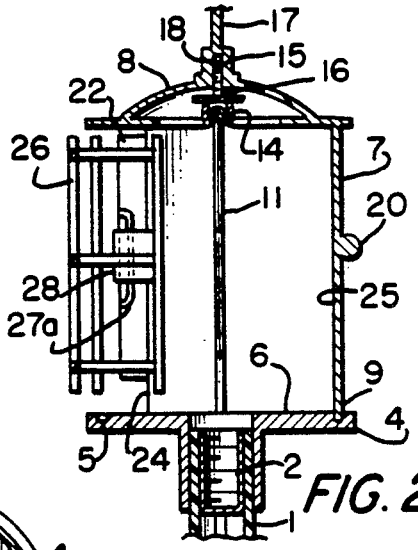
FIG. 2 is a cross-sectional view taken along line 2—2 of FIG. 1.
Figure 3:
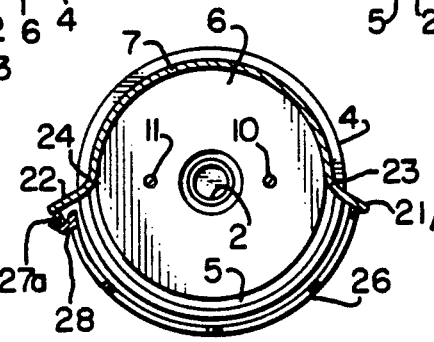
FIG. 3 is a cross-sectional view taken along line 3—3 of FIG. 1.

Referring to FIGS. 1, 2 and 3 the trouble lamp in accordance with the principles of the present invention includes a longitudinal handle 1 including therein at one end thereof a light bulb socket 2 to receive alight emitting bulb 3 therein. Secured to handle 1 adjacent to and coaxial with the socket 2 is a fixed circular base member 4 having a circular groove 5 in the upper surface 6 thereof adjacent the periphery of member 4. A partially circular-like, open sided shade member 7 extends outwardly from upper surface 6 having one end 8 closed and the other end 9 engaging groove 5. A stationary arrangement including rods 10 and 11 are fastened to base member 4 by nuts 12 and 13, or by some other appropriate means. Rods 10 and 11 extend outwardly from upper surface 6 to closed end 8 wherein they engage a carrier 14 having secured thereto a pivot member in the form of a bolt 15. Bolt 15 extends through an aperture 16 in closed end 8 and is threaded into the hanger 17 in the form of a threaded portion 18 and a hook 19.

Through cooperation of pivot member, bolt 15, and groove 5 shade member 7 may be rotated about bulb 3 so that light emitted therefrom cannot shine in the user's eyes regardless of how the trouble lamp positions itself when it is disposed in a working relationship with the apparatus upon which the user is working by means of hook 19. Rotation of shade member 7 can be accomplished by the member 20 fastened to the outer surface of shade member 7.

To enhance the shielding of the eyes of the user from the light emitted from bulb 3 from within the trouble lamp, a pair of members 21 and 22 are provided forming an extension of a different one of the two edges 23 and 24 of the open side of shade member 7. Each of the pair of members 21 and 22 are angled outwardly as best shown in FIG. 3 relative to shade member 7. The inner surface of shade member 7 is coated with a reflective material for light reflection, or shade member 7 is made of material that is light reflective.

To prevent contact with and to protect light bulb 3, a cage-like member 26 is provided to cover the open side of shade member 7. Cage-like member 26 is held in position by catch 27 secured to member 21 and a latch arrangement including member 27 a secured to member 22 cooperating with the groove extension 28 of cage-like member 26. The material of cage-like member 26 is flexible so that cage-like member 26 can be easily released from catch 27 and the latch arrangement including catch 27 and groove extension 28 to enable the easy replacement of bulb 3. The material of cage-like member 26 may either be flexible plastic or flexible metal with shade member 7 being made of a metallic material or a heat resistant plastic of a more rigid nature than that of cage-like member 26.

Handle 1 includes therein an electrical switch 29 of the push type and base member 4 can be fastened to handle 1 in many different ways one of which is shown in FIG. 1 including a flexible member 30 fastened to base member that may be clamped tightly to handle 1 by the screw 31 engaging flanges 32 and 33 on member 30.

Figure 4:
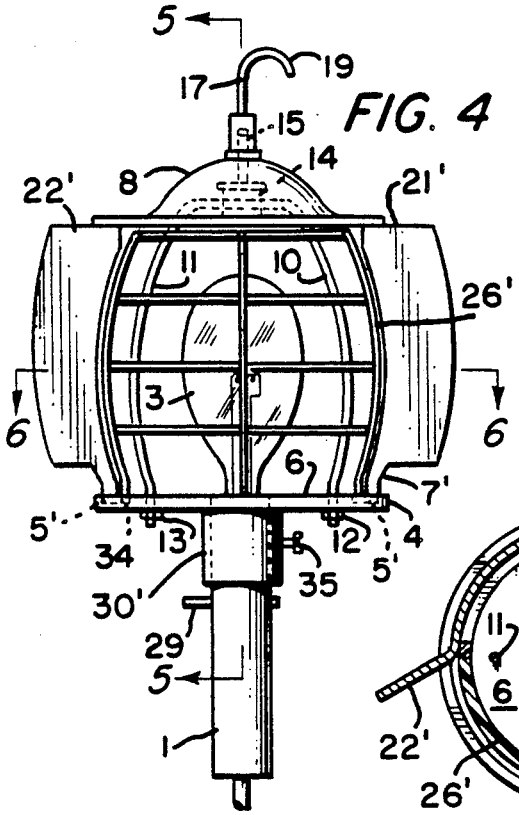
FIG. 4 is front view of a second embodiment of the trouble lamp in accordance with the principles of the present invention.
Figure 5:
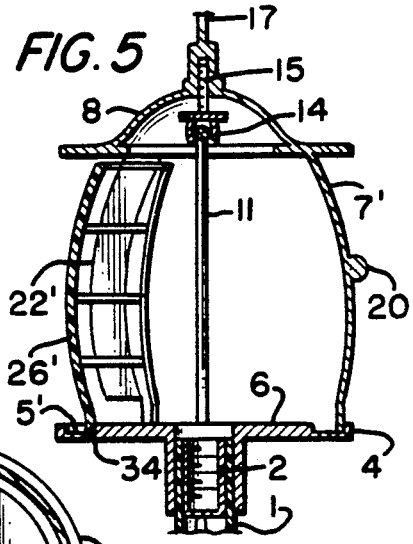
FIG. 5 is a cross-sectional view taken along line 5—5 of FIG. 4.
Figure 6:
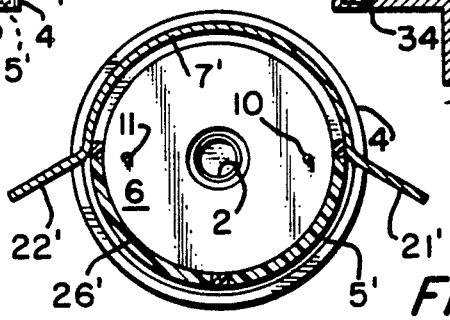
FIG. 6 is a cross-sectional view taken along line 6—6 of FIG. 4.

Referring to FIGS. 4, 5 and 6, a second embodiment of the trouble lamp in accordance with the principles of the present invention is shown. In this embodiment handle 1, circular base member 4 and the stationary arrangement including rods 10 and 11, coupling member 14 and the pivot member in the form bolt 15 in cooperation with enclosed end 8 of shade member 7' cooperate substantially as described with respect to FIGS. 1, 2, and 3. The primary difference is that shade member 7' in FIGS. 4, 5, and 6 is spherical-like rather than cylindrical-like as illustrated in FIGS. 1, 2, and 3. An additional difference is that circular groove 5' contained in base member 4 is wider than circular groove 5 of FIGS. 1, 2, and 3 so that a circular bottom member 34 of cage-like member 26' is accepted in groove 540 along with the other end 9 of shade member 7' to permit rotation of cage-like member 26' to a position inside of shade member 7' to enable changing light bulb 3. The pair of members 21' and 22' are again provided as an extension of a different one of the two edges of the open side of shade member 7' with each of the members 21' and 22' being angled outwardly relative to shade member 7' as shown in FIG. 6 to again enhance shielding of the eyes of a user from light emitted from the trouble lamp. These pair of members 21' and 22' also have a curved outer edge rather than a straight outer edge to conform to the curvature of the shade member 7'. Again base member 4 may be fastened to handle 1 by many different means one of which was shown in FIG. 1 and another of which is shown in FIG. 4 wherein a screw 35 passes through member 30' to securely fasten base member 4 to handle 1.

In each of the embodiments disclosed, when the trouble lamp is hung by hook 19 to position the light to shine upon the work piece and the user finds that the light emitted from the trouble lamp is impinging upon his eyes in a troublesome manner all that is necessary is to move shade member 7 or 7' by means of member 20 in a rotational manner about the pivot member provided by bolt 15 so that shade member 7 and 7' slides in groove 5 or 5' until the light from trouble lamp is no longer shining in the user's eyes. There is no need to reposition hook 19 to move the trouble lamp so that the light will no longer shine in the eyes of the user. It is just necessary to rotate shade member 7 or 7' relative to base member 4 in groove 5 or 5' about the pivot point provided by bolt 15 to eliminate light from the trouble lamp shining in the user's eyes.

While I have described above the principles of my invention in connection with specific apparatus, it is to be clearly understood that this description is made only by way of example and not as a limitation to the scope of my invention as set forth in the objects thereof and in the accompanying claims.

I claim:

1. A trouble lamp comprising:

a longitudinal handle including at one end thereof a light bulb socket;

a fixed circular base member secured to said handle adjacent said one end thereof in a coaxial relationship with said socket, said base member having a circular groove in an upper surface thereof adjacent the periphery thereof;

a partially circular-like, open sided shade member extending outwardly from said upper surface having one end thereof enclosed and the other end thereof engaging said groove; and a stationary arrangement extending from said upper surface to said enclosed end of said shade member to provide a pivot member for said shade member to enable rotation of said shade member about said pivot member in said groove.

2. A trouble lamp according to claim 1, further including a means connected to said stationary arrangement to enable hanging said trouble lamp.

3. A trouble lamp according to claim 2, further including a pair of members each forming an extension of a different one of the two edges of said open side of said shade member, each of said pair of members being angled outwardly relative to said shade member to enhance shielding the eyes of a user from light emitted from said trouble lamp.

4. A trouble lamp according to claim 3, further including a light reflecting surface on the inner surface of said shade member.

5. A trouble lamp according to claim 4, further including a cage-like member disposed to close said open side of said shade member to prevent contact with and to protect a light bulb disposed in said socket.

6. A trouble lamp according to claim 5, wherein said cage-like member is releasably secured to said pair of members to permit changing said bulb.

7. A trouble lamp according to claim 5, wherein said cage-like member includes at least a partially circular bottom member; and said circular groove is wide enough to accept said bottom member as well as said other end of said shade member to permit rotation of said cage-like member to a position inside of said shade member to enable changing said bulb.

8. A trouble lamp according to claim 5, wherein said shade member has a cylinder-like configuration.

9. A trouble lamp according to claim , wherein said cage-like member is releasably secured to said pair of members to permit changing said bulb.

10. A trouble lamp according to claim 5, wherein said shade member had a spherical-like configuration 11. A trouble lamp according to claim 10, wherein said cage-like member includes at least a partially circular bottom member; and said circular groove is wide enough to accept said bottom member as well as said other end of said handle member to permit rotation of said cage-like member to a position inside of said shade member to enable changing of said bulb.

12. A trouble lamp according to claim 1, further including a pair of member each forming an extension of a different one of the two edges of said open side of said shade member, each of said pair of members being angled outwardly relative to said shade member to enhance shielding the eyes of the user from light emitted from said trouble lamp.

13. A trouble lamp according to claim 12, further including a light reflecting surface on the inner surface of said shade member.

14. A trouble lamp according to claim 13, further including a cage-like member disposed to close said open side of said shade member to prevent contact with and to protect a light bulb disposed in said socket.

15. A Trouble lamp according to claim 14, wherein said cage-like member is releasably secured to said pair of members to permit changing said bulb.

16. A trouble lamp according to claim 14, wherein said cage-like member includes at least a partially circular bottom member; and said circular groove is wide enough to accept said bottom member as well as said other end of said shade member to permit rotation of said cage-like member to a position inside of said shade member to enable changing said bulb.

17. A trouble lamp according to claim 1, further including a light reflecting surface on the inner surface of said shade member.

18. A trouble lamp according to claim 1, further including a cage-like member disposed to close said open side of said shade member to prevent contact with and to protect a light bulb disposed in said socket.

19. A trouble lamp according to claim 18, wherein said cage-like member is releasably secured to the two edges of said open side of said shade member.

20. A trouble lamp according to claim 18, wherein said cage-like member includes a least a partially circular bottom member; and said circular groove is wide enough to accept said bottom member as well as said other end of said shade position inside of said shade member to enable changing said bulb.

* * * * *